United States Patent [19]

Kemper

[11] Patent Number: 4,534,597

[45] Date of Patent: Aug. 13, 1985

[54] MINING TOOL WITH AUTOMATIC SPRINKLER CONTROL

[75] Inventor: Franz Kemper, Essen, Fed. Rep. of Germany

[73] Assignee: Bergwerksverband GmbH, Essen, Fed. Rep. of Germany

[21] Appl. No.: 534,585

[22] Filed: Sep. 22, 1983

[30] Foreign Application Priority Data

Sep. 22, 1982 [DE] Fed. Rep. of Germany ..... 3234993

[51] Int. Cl.[3] ..... E21B 10/60

[52] U.S. Cl. ..... 299/81

[58] Field of Search ..... 299/81

[56] References Cited

U.S. PATENT DOCUMENTS

| | | | |
|---|---|---|---|
| 3,747,982 | 4/1973 | Agnew et al. | 299/81 |
| 4,049,318 | 3/1977 | Fruin | 299/17 |
| 4,219,239 | 6/1980 | Weikert et al. | 299/81 |

FOREIGN PATENT DOCUMENTS

| | | | |
|---|---|---|---|
| 10534 | 4/1980 | European Pat. Off. | 299/81 |
| 60827 | 8/1982 | European Pat. Off. | 299/81 |
| 621873 | 2/1978 | U.S.S.R. | 299/81 |
| 685821 | 1/1979 | U.S.S.R. | 299/81 |

*Primary Examiner*—James A. Leppink
*Assistant Examiner*—Michael Goodwin
*Attorney, Agent, or Firm*—Karl F. Ross; Herbert Dubno

[57] ABSTRACT

A mining tool with a rotary body carrying a number of peripherally spaced cutters has a water channel terminating in the vicinity of each cutter at a spray nozzle for the irrigation of particles such as coal dust detached from the mine face. The water supply for each nozzle is controlled by the associated cutter so as to be unblocked only when its working edge encounters resistance sufficient for a limited swing of the cutter shank about a pivotal axis against the force of a biasing spring, thereby opening a valve normally held closed by that spring.

4 Claims, 1 Drawing Figure

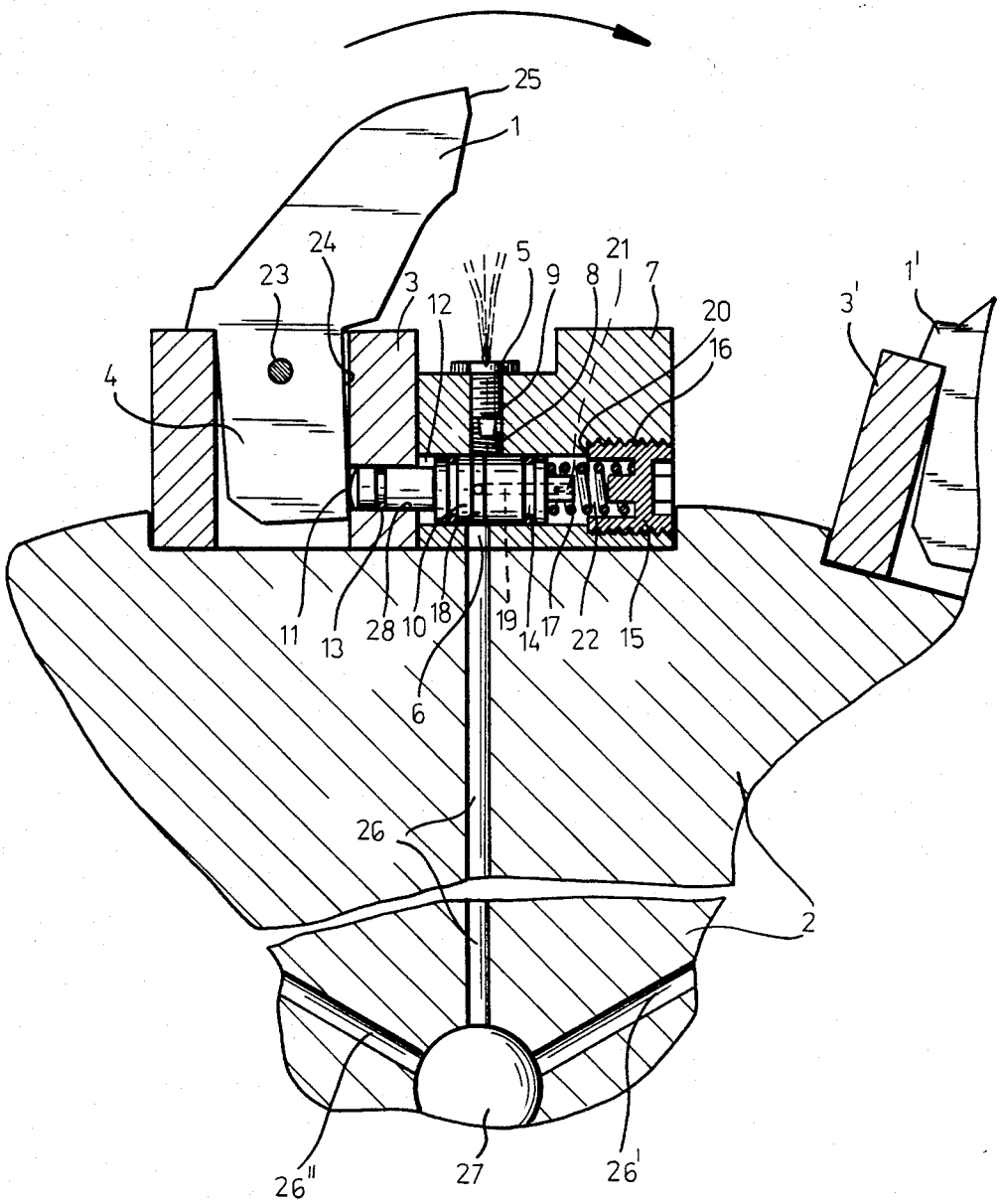
25
1
24
23
3
12
5
9
8
21
7
20
16
1'
3'
4
11
13
28
10
18
19
14
17
22
15
6
26
2
26''
27
26'

MINING TOOL WITH AUTOMATIC SPRINKLER CONTROL

FIELD OF THE INVENTION

My present invention relates to a mining tool of the type having a rotary body which carries a number of peripherally spaced cutters or picks that are each provided with a working edge facing in the direction of rotation.

BACKGROUND OF THE INVENTION

Such a tool may be used to work at a mine face on a seam of anthracite coal, for example, whose fragmentation by the rotating cutters gives rise to considerable dust development. Continuous sprinkling of the detritus with water enables the dust to be precipitated and to be carried off for further processing. For economic reasons, and to simplify the recovery by avoiding the need for a separate drying step, it is desirable to hold the water supply within moderate limits, e.g. at or below 6% by weight of the extracted coal. Thus, rotary heads carrying axially projecting picks have been provided in the past with valves which block the flow as long as the picks are not in contact with a mine face. The valve responds to axial pressure and thus unblocks the flow intermittently as the tool is progressively advanced into the seam.

When the cutters project generally radially from the periphery of the rotary body, e.g. with shearer-type mining tools or augers as described for example in U.S. Pat. Nos. 3,747,982 and 4,219,239, such a control cannot be used since the cutters are not axially shiftable. Moreover, each individual cutter comes into working contact with the mine face only during part of a revolution. The cutters, therefore, need not be supplied with water during their nonworking phases. For this purpose it is known, e.g. as noted in the aforementioned U.S. Pat. No. 3,747,982, to control the water supply by means of a distributor cutting off the flow to a segment remote from the mine face, yet this will not prevent the unneeded emission of water from an opposite segment when the cutters thereof are not in contact with the mine face.

OBJECT OF THE INVENTION

Thus, the object of my present invention is to provide a mining tool of the type referred to with means for effectively controlling the supply of water in accordance with the activity of each cutter.

SUMMARY OF THE INVENTION

I realise this object, in accordance with my present invention, by mounting the shank of each cutter on its supporting body with freedom of limited pivotal motion in a plane perpendicular to the axis of rotation and providing biasing means acting upon the shank to urge the working edge of the cutter forward in the direction of rotation. A conduit connected to a supply of water under pressure includes a channel which terminates at an outlet in the vicinity of each cutter, the outlet being provided with one or more nozzles sprinkling water onto a mine face being worked at and onto the mineralic matter detached from that face, referred to hereinafter for convenience as coal. A valve interposed between the channel and its outlet significantly reduces or completely blocks the flow of water to the nozzle or nozzles in a normal position but is displaceable by the shank of the associated cutter into an unblocking position upon repression of the working edge of the cutter against the force of the biasing means by contact with the mine face.

According to the embodiment more particularly described hereinafter, the shank of each cutter is pivotally mounted in a holder having a bore generally perpendicular to that shank which communicates with the associated channel and its outlet. The valve controlled by the cutter comprises a piston which is movable in the bore and is urged into contact with the cutter shank by a spring constituting the biasing means. The piston has a passage, preferably a peripheral groove, which opens onto the outlet only in the unblocking position but advantageously has an extension through which water under pressure can reach the back of the piston in order to supplement the retaining action of the biasing spring in the normal position.

BRIEF DESCRIPTION OF THE DRAWING

The above and other features of my invention will now be described in detail with reference to the accompanying drawing the sole FIGURE of which is a fragmentary cross-sectional view of a rotary body of a mining tool provided with a set of cutters controlling an irrigation system in accordance with my invention.

SPECIFIC DESCRIPTION

The drawing illustrates part of a rotary body 2 which could be a drum of the type shown in U.S. Pat. No. 4,049,318, for example. Body 2 carries a number of generally radially projecting holders 3, 3' etc. (only two shown) accommodating respective cutters or picks 1, 1' etc. Though these holders are shown positioned directly on the periphery of body 2, they could also be mounted on one or more helical loading vanes when that body is designed as an auger shaft of the type described in the two U.S. patents mentioned earlier.

Cutter or pick 1, which of course is representative of all other cutters of the mining tool, has a shank 4 which in contrast to conventional arrangements is not fixedly mounted in its holder but is limitedly pivotable about a pin 23 in a plane perpendicular to the axis of body 2. Shank 4 has a flattened side 24 which is in permanent contact with tip 11 of a piston 10 slidable in a cylinder bore 12 of a block 7 adjoining the holder 3; piston extremity 11 is received in a transverse bore 28, formed in the wall of holder 3, and carries a packing ring 13 designed to prevent the escape of water under pressure which enters the cylinder 12 from a central conduit 27 in body 2 through a branch channel 26 and an aperture 6 in the inner wall of block 7. Similar branch channels 26', 26'' are seen to extend from central conduit 27 within body 2 to corresponding blocks mounted adjacent holder 3' and other holders not shown.

Piston 10 is provided with further packing rings 14 flanking an annular groove 18 which permanently communicates with channel 26 via aperture 6 and, in the illustrated unblocking position, opens onto an outlet 8 into which a spray nozzle 5 is inserted with the aid of threads 9. Piston 10 is biased toward the left, into contact with shank 4, by a compression spring 17 partly received in a cavity 22 of a cap nut 15 engaging internal threads 16 of the right-hand end of bore 12, the nut resting against a shoulder 20 of that bore. An axial bore 19 in piston 10 communicates through a radial extension thereof with groove 18 and opens at its opposite end into the part of cylinder 12 containing the spring 17.

In operation, body 2 is assumed to rotate clockwise about its axis whereby a working edge 25 of pick 1 cuts into an adjoining mine face during part of a revolution. Fragments of rock and coal broken from that mine face are irrigated by water emitted from nozzle 5 to suppress dust formation; this is possible because the reaction of the mineral matter attacked by the pick represses same against the force of spring 17 to swing it from a normal position into the illustrated unblocking position in which its flank 24 rests against the wall of holder 3 while the groove 18 of piston 10 communicates with outlet 8 to let the water from channel 26 reach the nozzle. When the pick 1 leaves the mine face, spring 17 advances the piston 10 to the left so that pick 1 swings into its normal or inactive position as groove 18 cuts off the outlet 8 while remaining in communication with aperture 6; this lets water under pressure flow through bore 19 into the right-hand part of cylinder 12 to reinforce the biasing action of spring 17 tending to hold the pick in its normal position. The beginning unblocking of outlet 8 upon initial contact with the mine face creates a toggle effect accelerating the restarting of the water jet. The biasing force can be reduced, if necessary, by partly unscrewing the nut 15, e.g. with interposition of one or more washers between that nut and shoulder 20.

In order to facilitate disassembly for purposes of inspection or repair, the right-hand end of bore 19 is advantageously provided with female threads 21 enabling the engagement of piston 10 by a complementarily threaded implement by which the piston can be extracted.

As will be apparent from the foregoing description, the pivotal mounting of pick 1 in its holder 3 and the associated valve assembly in block 7 ensures that water from supply conduit 27 is emitted by the associated nozzle 5 only when that pick is actually cutting into a mine face. The disclosed assembly can be readily installed on existing mining augers or cutter-carrying drums; it should also be noted that the valve assembly 10–22 is well protected by block 7 against damage by mineral fragments striking the peripheral surface of the tool.

When the piston 10 is nonrotatably held in its cylinder bore 12, the peripheral groove 18 could be replaced by a throughgoing diametrical passage opening directly into axial bore 19.

If desired, the outlet 8 could be slightly enlarged or shifted to the left so that the outflow of spray water is throttled but not completely stopped in the normal position of pick 1. In any event, the significant reduction or blocking of the water supply to the nonworking picks enable the flow to the active picks to be intensified for effectively cooling same while precipitating the evolving dust. This will help prevent sparking and thus will minimize the risk of underground explosion.

I claim:

1. A mining tool comprising:

a generally cylindrical body rotatable about an axis;

a plurality of cutters peripherally spaced on said body and provided each with a working edge facing in the direction of rotation, each cutter further having a shank mounted on said body with freedom of limited pivotal motion in a plane substantially perpendicular to said axis;

conduit means connected to a supply of water under pressure, said conduit means including a channel terminating at an outlet in the vicinity of each of said cutters;

nozzle means in said outlet for sprinkling water onto a mine face attacked by said working edge;

valve means interposed between said channel and said outlet for significantly reducing the flow of water to said nozzle means in a normal blocking position, said valve means including a piston in contact with and generally perpendicular to said shank; and biasing means acting upon said shank to urge said working edge forward in the direction of rotation, said piston being displaceable by said shank from said normal position into an unblocking position upon repression of said working edge against the force of said biasing means by contact with said mine face, said shank being pivotally mounted in a holder provided with a bore generally perpendicular thereto, said channel and said outlet communicating with said bore, said piston being movable in said bore, said biasing means comprising a spring bearing upon said shank through the intermediary of said piston, said bore having an end remote from said shank provided with removable closure means, said spring being inserted in a space between said piston and said closure means, said piston having a passage aligned with said channel and said outlet in said unblocking position but cut off from said outlet in said normal position, said passage having an extension permanently connecting said channel with said space whereby water entering said passage from said channel in said normal position exerts pressure upon said piston supplementing the spring force.

2. A mining tool as defined in claim 1 wherein said extension has internal threads accessible by a piston-extracting implement upon removal of said closure means.

3. A mining tool as defined in claim 1 wherein said passage includes a peripheral groove on said piston.

4. A mining tool as defined in claim 1 wherein said removable closure means comprises a cap nut threaded into said bore, said cap nut having a recess receiving part of said spring.

* * * * *